United States Patent [19]

Beasley

[11] Patent Number: 4,906,801

[45] Date of Patent: Mar. 6, 1990

[54] ANIMAL GUARD FOR POWER TRANSFORMERS

[76] Inventor: Tania M. Beasley, 1206 S. Lone Pine, Springfield, Mo. 65804

[21] Appl. No.: 354,738

[22] Filed: May 22, 1989

[51] Int. Cl.[4] ..... H01B 17/00

[52] U.S. Cl. ..... 174/5 R; 336/105

[58] Field of Search ..... 174/5 R, 16.1, 138 F, 174/139; 336/105; 361/38, 39, 40

[56] References Cited

U.S. PATENT DOCUMENTS

| | | | |
|---|---|---|---|
| 2,263,319 | 11/1941 | Treanor | 174/5 R X |
| 3,035,209 | 5/1962 | Smith, Jr. | 361/39 |
| 4,201,883 | 5/1980 | Shepherd | 174/5 R X |

FOREIGN PATENT DOCUMENTS

| | | | |
|---|---|---|---|
| 620872 | 5/1961 | Canada | 174/138 F |

OTHER PUBLICATIONS

Advertisement: "New 'Sky-Blue Covers' on Pole Star Distribution Transformers Prevent Animal-Caused Outages . . . and Protect Wildlife!", *Electrical World*, vol. 154, No. 6, Aug. 8, 1960, pp. 66 and 67.

*Primary Examiner*—Laramie E. Askin

*Attorney, Agent, or Firm*—Kokjer, Kircher, Bradley, Wharton, Bowman & Johnson

[57] ABSTRACT

A cover for application to a top surface and adjacent portion of the sidewall of a distribution transformer to prevent electrical shorting across the top surface and sidewall portion. The cover comprises an electrically non-conductive material which electrically insulates the transformer top surface and sidewall portion. An aperture is provided in the cover to accommodate a terminal of the transformer.

14 Claims, 1 Drawing Sheet

ANIMAL GUARD FOR POWER TRANSFORMERS

BACKGROUND OF THE INVENTION

This invention relates in general to power transformers and, more particularly, to an insulating guard to prevent shorting of the power transformers.

Power transformers are widely utilized to step down the high transmission voltage in power lines to a level satisfactory for industrial and household usage. The transformers generally have exposed bushing terminals with lead wires attached to the terminals. Because of the exposed condition of the hot incoming wire, the terminals present a significant electrocution hazard to humans as well as animals who come into simultaneous contact with the hot wire and the uninsulated transformer housing.

Previous attempts to reduce this electrocution hazard have focused on providing a protective covering for the bushing terminal. U.S. Pat. No. 3,766,310 to Paschen is illustrative of one such type of protective cover which is elbow-shaped and is designed to cover an angular connection between the electrical conductors and the bushing terminal. While covering the bushing terminal in this manner is effective to reduce the likelihood of shorting across the low-voltage terminal, it is not adaptable to protect the high-voltage terminal. Moreover, covering the high-voltage terminal would not eliminate the risk of electrocution presented by the high voltage line itself.

U.S. Pat. No. 3,243,504 to Johnson and U.S. Pat. No. 3,457,360 to D'Entremont disclose other types of terminal insulators. These insulators, however, also fail to reduce the risk of electrocution presented by simultaneous contact of the high voltage line and the grounded transformer housing.

SUMMARY OF THE INVENTION

It is an object of this invention to provide a power transformer with an insulating cover which reduces the risk of electrocution and shorting of the transformer and which is protective not only when the terminals and transformer housing are simultaneously contacted, but which is also protective when the high voltage line and portions of the housing are contacted.

As a corollary to the preceding object, it is also an object of this invention to provide a power transformer with an insulating cover which is adaptable to accommodate different configurations of terminals extending from the housing.

To accomplish these and other related objects of the invention, a cover is provided which is applicable to transformers. The cover includes a lid sized for covering a top surface of the transformer, a skirt which extends downwardly from the periphery of the lid and a strap or other means for securing the skirt to a sidewall of the transformer housing. An aperture is formed in the lid to accommodate he transformer high-voltage terminal. The lid comprises an electrically non-conductive material to prevent electrical shorting across the top surface of the transformer. The cover is thus protective against shorting caused by simultaneous contact across the incoming high-voltage wire and the top of the transformer. The cover is also protective when there is simultaneous contact across the high-voltage terminal and the top surface.

BRIEF DESCRIPTION OF THE DRAWINGS

In the accompanying drawings in which like reference numerals are used to indicate like parts in the various views.

DESCRIPTION OF THE PREFERRED EMBODIMENT

Figure 2:
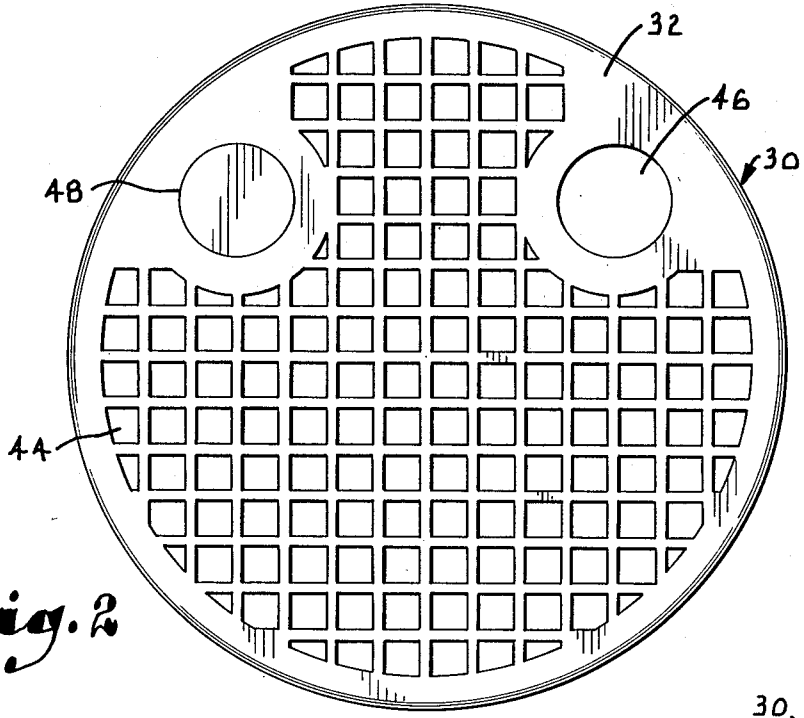
FIG. 2 is a top plan view of the transformer cover of FIG. 1 shown on an enlarged scale.
Figure 3:
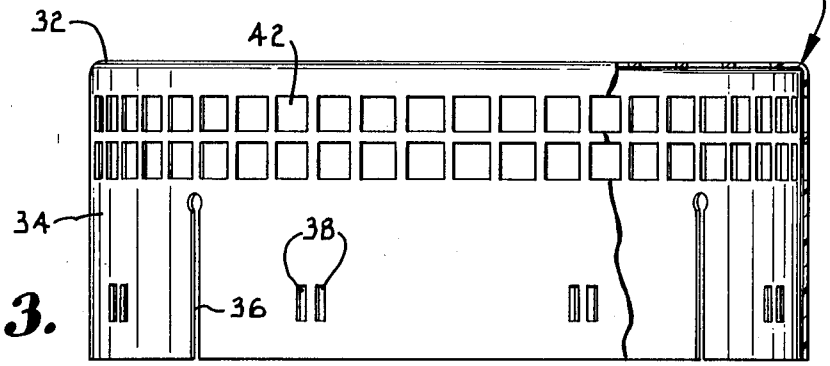
FIG. 3 is a side elevational view of the transformer cover of FIG. 1 shown on an enlarged scale and with portions broken away to illustrate details of construction.
Figure 1:
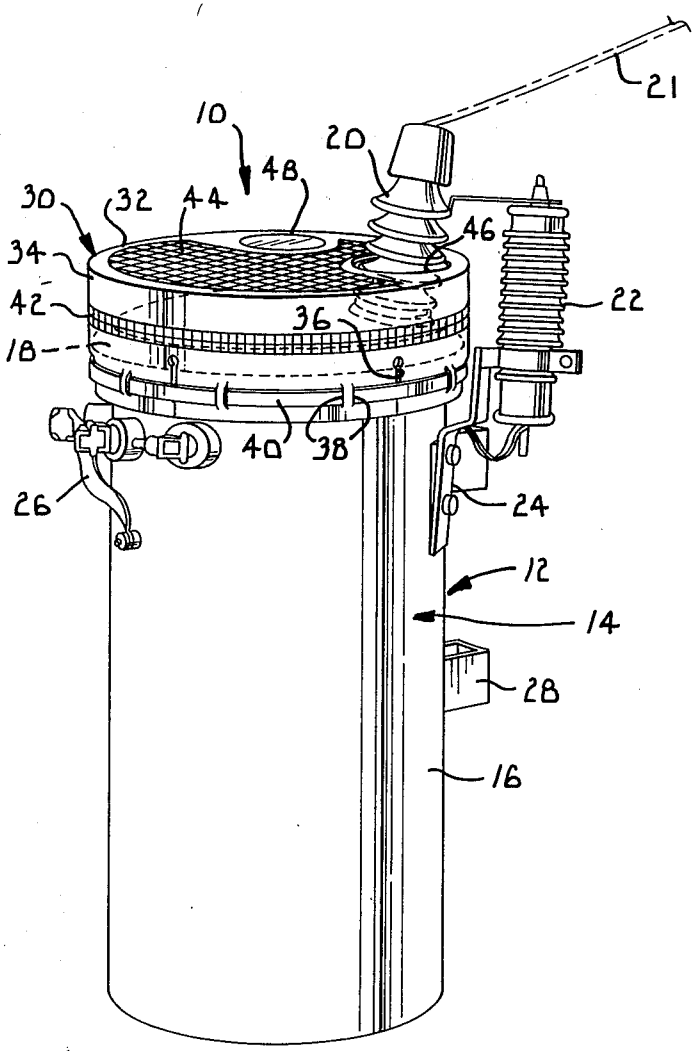
FIG. 1 is a side perspective view of a transformer cover of the present invention shown applied to a conventional distribution transformer.

Referring now to the drawings in greater detail, a transformer assembly of the present invention is represented broadly by the numeral 10. Transformer assembly 10 comprises a distribution transformer 12 having an external housing 14 which includes a cylindrical sidewall 16 and a top 18. The peripheral edge of top 18 is outwardly spaced from the sidewall 16.

A high voltage bushing terminal 20 extends from the top 18 of the housing and is connected to a high voltage power line 21. A low voltage bushing terminal 22 is mounted by bracket 24 to the sidewall 16 of the housing. A voltage grounding mechanism 26 and a mounting bracket 28 are also connected to the sidewall of the housing.

The transformer assembly 10 also includes a cover 30 which is applied to the top 18 and adjacent portion of the sidewall 16 of housing 14. The cover is formed from a material which is substantially electrically non-conductive. The material selected must be durable to withstand weathering even after prolonged exposure to sunlight. The material should also be semi-rigid so that the cover maintains its configuration when applied to the transformer. Many well known types of "rubber-like" thermoplastic and other materials possess these desired characteristics.

Cover 30 comprises a discoidal lid 32 and a skirt 34 which extends downwardly along a peripheral edge of the lid. Skirt 34 is preferably of sufficient length to permit the lid 32 to be spaced above the top 18 of transformer housing 14. Skirt 34 includes a plurality of circumferentially spaced slots 36 which extend upwardly from a bottom edge of the skirt. A plurality of pairs of eyelets 38 are also circumferentially spaced in the skirt. An adjustable strap 40 is laced through each pair of eyelets and may be tightened to maintain the cover in place. Strap 40 may comprise many suitable types of material such as nylon and other flexible yet durable materials.

Rows of square-shaped ventilating openings 42 are provided in the skirt and are positioned above the upper end of slots 36. Similar ventilating openings 44 are provided in the lid 32 and are positioned in a grid-like fashion. The size and spacing of the openings are selected so that the lid comprises greater than one-half open space to provide for adequate ventilation.

The lid 32 also includes an aperture 46 which is sized and positioned for accommodating high voltage bushing terminal 20. A score line 48 defines an auxiliary aperture which may be utilized if the transformer contains two top mounted terminals. It is to be understood that the cover may also be constructed to accommodate transformer terminals which extend from the housing sidewall rather than the top of the housing.

In use, the cover 30 is applied to the transformer housing 14 to electrically insulate the top 18 and adjacent portion of sidewall 16. The nylon strap 40 is fed through the eyelets 38 and tightened against the transformer sidewall 16 to secure skirt 34 to the transformer. The slots 36 are important to permit the necessary flexibility in the skirt to ensure a tight fit of the strap against the transformer sidewall.

The lid 32 of cover 30 is preferably spaced above transformer top 18 to provide for air circulation through ventilating openings 42 and 44 which are likewise spaced above the transformer top. Spacing of the lid above the transformer top also reduces the likelihood of shorting across the transformer top if an animal or other object should extend partially through the ventilating openings 44 while in contact with the high voltage line 21.

Displacement of the cover is prevented once the strap 40 is tightened against the transformer sidewall. The shoulder presented by the undersurface of that portion of the housing top 18 which extends out beyond the housing sidewall 16 blocks upward movement of the strap and hence the cover. The low voltage grounding mechanism 26 likewise prevents downward movement of the cover. Once in place, the cover can be dislodged only upon removal of the banding strap 40.

It can thus be seen that the cover 30 is effective to reduce the likelihood of electrocution and shorting out of the terminal. The cover is protective against shorting caused not only by simultaneous contact across the housing and the terminals, but is also protective against shorting caused by simultaneous contact across the high-voltage line 21 and the covered portions of the housing.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A cover for application to a transformer, said cover comprising:

a discoidal lid sized for covering a top surface of said transformer, said lid comprising an electrically non-conductive material and having at least one aperture sized and positioned for accommodating a terminal of the transformer;

a plurality of ventilating openings in said lid;

a skirt extending downwardly from the periphery of said lid; and means for securing said skirt to the transformer, whereby said transformer top surface is electrically insulated to prevent electrical shorting across the top surface.

2. The invention of claim 1, including a plurality of circumferentially spaced slots in said skirt, each said slot extending upwardly from a bottom edge of said skirt.

3. The invention of claim 1, wherein said means comprises a strap which encircles said skirt and is adjustable to tightly engage a sidewall of said transformer when applied thereto.

4. The invention of claim 3, including a plurality of spaced apart eyelets in said skirt, wherein said strap extends through said eyelets.

5. A cover for application to a transformer, said cover comprising:

a lid sized for covering a top surface of said transformer;

a skirt extending downwardly from the periphery of said lid;

an aperture positioned in either said lid or skirt to accommodate a terminal extending from a housing of the transformer;

a plurality of eyelets in said skirt; and a strap coupled with said skirt to secure the cover to the transformer, said strap extending through said eyelets, wherein said lid and skirt comprise an electrically non-conductive material to electrically insulate the transformer housing when applied thereto.

6. The invention of claim 5, including a plurality of circumferentially spaced slots in said skirt, each said slot extending upwardly from a bottom edge of said skirt.

7. The invention of claim 5, including a plurality of ventilating openings in the lid.

8. The invention of claim 7, including a plurality of ventilating openings in the skirt.

9. A transformer assembly comprising:

a housing having a sidewall and a top surface;

a cover applied to the top surface and an adjacent portion of the sidewall of the housing, said cover comprising an electrically non-conductive material and including an aperture and said cover being spaced above said top surface and including a plurality of ventilating openings; and a terminal extending from said housing and through said aperture, wherein said cover electrically insulates the top surface and adjacent portion of the sidewall of the housing to prevent electrical shorting across said surface and sidewall portion.

10. The invention of claim 9, wherein said cover includes a lid and a skirt extending downwardly from the periphery of the lid.

11. The invention of claim 10, including a plurality of circumferentially spaced slots in said skirt, each said slot extending upwardly from a bottom edge of said skirt.

12. The invention of claim 11, including a strap which encircles said skirt and is adjustable to tightly engage the sidewall of the housing.

13. The invention of claim 12, including a plurality of spaced apart eyelets in said skirt, wherein said strap extends through said eyelets.

14. A cover for application to a transformer, said cover comprising:

a discoidal lid sized for covering a top surface of said transformer, said lid comprising an electrically non-conductive material and having at least one aperture sized and positioned for accommodating a terminal of the transformer;

a skirt extending downwardly from the periphery of said lid;

a plurality of circumferentially spaced slots in said skirt, each said slot extending upwardly from a bottom edge of said skirt; and means for securing said skirt to the transformer, whereby said transformer top surface is electrically insulated to prevent electrical shorting across the top surface.

* * * * *